United States Patent [19]

Koboshi et al.

[11] Patent Number: 4,764,453

[45] Date of Patent: Aug. 16, 1988

[54] METHOD OF PROCESSING SILVER HALIDE COLOR PHOTOGRAPHIC MATERIAL

[75] Inventors: Shigeharu Koboshi, Sagamihara; Masayuki Kurematsu, Hachioji, both of Japan

[73] Assignee: Konishiroku Photo Industry Co., Ltd., Tokyo, Japan

[21] Appl. No.: 874,815

[22] Filed: Jun. 12, 1986

Related U.S. Application Data

[63] Continuation of Ser. No. 656,953, Oct. 2, 1984, abandoned.

[30] Foreign Application Priority Data

Dec. 26, 1983 [JP] Japan ..... 58-244268

[51] Int. Cl.[4] ..... G03C 7/16; G03C 7/40

[52] U.S. Cl. ..... 430/351; 430/372; 430/428; 430/432; 430/463; 430/352

[58] Field of Search ..... 430/351, 352, 372, 432, 430/428, 463

[56] References Cited

U.S. PATENT DOCUMENTS

| | | | |
|---|---|---|---|
| 2,922,352 | 1/1960 | Tuttle et al. | 430/432 |
| 2,956,877 | 10/1960 | Land et al. | 430/463 |
| 3,093,479 | 6/1963 | Olivares et al. | 430/372 |
| 3,335,004 | 4/1967 | Wrisley et al. | 430/372 |
| 3,512,979 | 5/1970 | Nagae et al. | 430/372 |
| 3,666,468 | 5/1972 | Amano et al. | 430/432 |
| 4,472,495 | 5/1972 | Degginger | 430/432 |
| 4,567,134 | 1/1986 | Koboshi et al. | 430/432 |

FOREIGN PATENT DOCUMENTS 071402 7/1982 European Pat. Off. .

OTHER PUBLICATIONS

Products Licensing Index, No. 62, Jun. 1969, p. 29.

*Primary Examiner*—Richard L. Schilling
*Attorney, Agent, or Firm*—Jordan B. Bierman

[57] ABSTRACT

A method of processing a silver halide color photographic material is disclosed. This method comprises developing said photographic material, removing the residual image-forming silver, treating, in the substantial final stage of color processing, the material with an aqueous solution containing a compound which releases ammonium ions in the solution, thereafter drying the material at a temperature not lower than 30° C., and adjusting the pH of the surface of the dried emulsion layer to between 3.0 and 6.8.

18 Claims, No Drawings

METHOD OF PROCESSING SILVER HALIDE COLOR PHOTOGRAPHIC MATERIAL

This application is a continuation of application Ser. No. 656,953, filed Oct. 2, 1984, now abandoned.

FIELD OF THE INVENTION

The present invention relates to a method for stabilizing silver halide color photographic materials. More particularly, the invention relates to a method of stabilizing a photographic dye and providing a photographic image with improved mold resistance, thereby permitting the prolonged storage of a photographic material.

BACKGROUND OF THE INVENTION

A great number of compounds are known to be used as mold inhibitors and many of them are actually used in commercial applications. However, not all of the conventional mold inhibitors can be used in silver halide color photography. Only a limited number of the known mold inhibitors are capable of exhibiting the desired effect without adversely affecting the photographic properties of the material and the storage stability of the photographic image. As is generally known, image dyes used in color photographic materials are vulnerable to a hot and humid atmosphere because such atmosphere provides a favorable condition for mold growth which is harmful to the dye image. Furthermore, an excretion from the mold or fungi discolors the dye.

Photographic materials are usually stored as they are pasted onto a paper leaf in an album or onto a mount. Alternatively, they are held between slide frames or wrapped with Japanese paper which is then held between frames. In these methods, the glue or paper fibers provide a nutrient for the growth of fungi, and this problem is particularly easy to occur in a hot and humid atmosphere, causing the discoloration of an image dye, particularly a cyan dye.

Formalin, benzoic acid, citric acid and acetic acid have been used for many years as mold inhibitors in silver halide color photographic materials. However, these compounds do not always ensure satisfactory results in mold inhibition. On the contrary, some compounds provide a nutrient for mold growth, and the problem is particularly conspicuous when acetic acid or citric acid is used. If citric acid is used in a stabilizer, a photographic material processed with the stabilizer is highly sensitive to mold growth upon long-term standing.

Photographic Science & Engineering, Vol. 3, May--June 1959 shows on page 132 that while ten-odd mold inhibitors are available, only pentachlorophenol is effective in application to color photographic images. However, this compound is harmful to humans.

Other mold inhibitors known in the art include mucochromium compounds (see U.S. Pat. No. 2,226,183), hydantoin and its derivatives (see U.S. Pat. No. 2,762,708), carboxyalkylpentahalobenzenethiol (see U.S. Pat. No. 2,897,081) and cerium hydrochloride or nitrate (see U.S. Pat. No. 3,185,571). Other relevant prior art references are U.S. Pat. Nos. 2,663,639, 3,503,746, 3,542,810 and 3,778,276, British Patents Nos. 987,010 and 1,065,920, and Japanese Patent Public Disclosure No. 157244/1982. However, almost all of the compounds shown in these references are organic sterilizers which are either expensive or highly oxidizable or sublimable to lose their efficacy within a short period of storage. It is therefore necessary to develop a mold inhibitor that is non-toxic and permits a photographic material to be stored over a prolonged period while inhibiting the mold growth.

Common recommendations in color photography are that dye images should be used under acidic conditions. However, if known organic acids are used as mold inhibitors, they become a source of nutrients for mold growth and impair rather than improve the stabily of dye images. This is another reason for the strong need for the development of an image stabilizer that exhibits its desired function effectively without causing mold growth in a photographic material.

The term "stabilization" of a silver image is often used in the processing of color photographic materials. This is the technique of fixing a not-to-be-washed black-and-white image, particularly silver image, and is shown in T. H. James; "The Theory of the Photographic Process", 4th Ed. Macmillan Publishing Co., Inc., p. 444. Several patent applications have been filed since 1943 concerning improvements of this technique; see, for example, British Patent No. 589,560 and U.S. Pat. Nos. 2,453,346, 2,453,347 and 2,448,857. Around 1965, a method was proposed for using ammonium thiocyanate to stabilize a silver image formed on the black-and-white photographic material. However, the processing method of the present invention is to stabilize color images formed on the color photographic material, and, therefore, is entirely different in technical idea from the method mentioned above.

SUMMARY OF THE INVENTION

Therefore, the primary object of the present invention is to provide a method for processing a silver halide photographic color material so as to produce a dye image that remains stable and keeps its color for an extended period of storage without permitting mold generation of growth.

As a result of various studies made to achieve this object, the present inventors have found that it can be attained by a method which comprises developing a silver halide color photographic material, removing the residual image-forming silver, treating, in the substantial final stage of color processing, the material with an aqueous solution containing a compound which is chemically stable and releases ammonium ions in the solution, thereafter drying the material at a temperature not lower than 30° C., and adjusting the pH of the surface of the dried emulsion layer to between 3.0 and 6.8.

DETAILED DESCRIPTION OF THE INVENTION

The compound of the present invention may be any compound which releases ammonium ions in an aqueous solution (this compound is hereinafter referred to as an ammonium ion releasing compound). This ammonium ion releasing compound is preferably one which is chemically stable, covering all compounds that have neither oxidizing nor reducing nature and which do not contain oxidative heavy metal ions such as iron, copper, nickel, cerium, manganese and vanadium, or are not decomposed to produce oxo-reducing halogen or sulfur ions, and which release ammonium ions ($NH_4^+$) in an aqueous solution.

Specific examples of the ammonium ion releasing compound used in the present invention include aqueous solution of ammonia (usually 28 wt %), ammonium hydroxide, ammonium carbonate, ammonium hydrogencarbonate, ammonium sulfate, ammonium hydrogensulfate, ammonium nitrate, ammonium sulfamate, ammonium benzoate, ammonium hydroxyethyliminodiacetate, ammonium trans-cyclohexanediamintetraacetate, ammonium nitrilotrimethylenephosphonate, ammonium ethylenediamintetramethylenephosphonate, ammonium 1-hydroxyethylidene-1,1'-diphosphonate, ammonium 2-phosphonbutane-1,2,4-tricarboxylate, ammonium alum and ammonium cerium (IV) sulfate.

Particularly preferred ammonium ion releasing compounds include, aqueous solution of ammonia, ammonium hydroxide, ammonium sulfate, ammonium hydrogensulfate, ammonium carbonate, ammonium hydrogencarbonate, ammonium alum, and ammonium 1-hydroxyethyldine-1,1'-diphosphonate. The most preferred are ammonium hydroxide and ammonium 1-hydroxyethylidene-1,1'-diphosphonate.

Ammonium salts of lower organic acids such as ammonium citrate are not desired since they are unable to prevent mold growth in spite of their chemical stability.

The ammonium ion releasing compound of the present invention is used in an amount ranging from 0.01 to 30 g per liter of the stabilizing solution, and the range of 0.1 to 5 g per liter is preferred. If the addition of the ammonium ion releasing compound is too small, mold generation easily occurs and the intended prevention of discolored dye is impossible. If the addition of the compound is too great, no mold grows but on the other hand, dye discoloration easily occurs.

The stabilization according to the present invention may be performed after the washing step. In a preferred embodiment, the washing step may be substantially eliminated. The phrase "substantially eliminating the washing step" does not exclude the provision of a silver recovery bath or rinse bath between the bleach-fix bath or fix bath and the stabilizing bath. In the present invention, the stabilization is performed preferably in a countercurrent, multistage fashion.

The stabilizing solution according to the present invention is preferably used at a pH in the range of 1 to 9.5, more preferably in the range of 3 to 8.5, and the range of 4 to 8 is particularly preferred. If the stabilization is effected in a continuous, countercurrent, multistage fashion with a plurality of stabilizing baths the last stage of which is supplied with a replenisher.

The stabilizing solution may contain a pH modifier which may be selected from among any known alkalis or acids. The pH modifier is preferably used in the least possible amount that does not affect the purpose of mold prevention. If possible, the use of the pH modifier should be avoided.

The pH modifier that may be used in the present invention is preferably a "chemically stable compound" which has the same meaning as defined for the ammonium ion releasing compound.

In the method of the present invention, the surface of the emulsion layer on the photographic material that has been dried in the drying step is adjusted to have a pH in the range of 3,0 to 6.8, preferably 4.0 to 6.0.

The pH of the surface of the emulsion layer means the common logarithm of the reciprocal of the molar concentration of hydrogen ions in the surface of a color photographic material as is swollen by a small amount of pure water. For pH measurement, an ordinary pH meter comprising a glass electrode and a reference calomel electrode may be used. For the purpose of measuring the lowest pH of the surface coat with pure water, an integrated flat-type composite electrode is usually employed.

The stabilizing solution according to the present invention may contain other various additives such as a brightener, a.surfactant, a preservative, a chelating agent, a hardener and an antistat. Any additives may be used in any combinations so long as they are not detrimental to the photographic characteristics of the silver halide color photographic material.

No washing step is required after the stabilization performed according to the present invention, but if necessary, rinsing with a small amount of water or surface washing may be conducted for a very short period. It is desired that the stabilized photographic material is directly subjected to the drying step. The temperature for the stabilization is generally in the range of 10° to 60° C., preferably 15° to 40° C. For the purpose of rapid processing, the duration of the stabilizing treatment is preferably as short as possible. Usually, the duration of the stabilization treatment lasts from 20 seconds to 10 minutes, most preferably from 30 seconds to 5 minutes.

The drying step is usually conducted at temperatures not lower than 30° C., preferably not lower than 50° C. If the drying temperature is too high, cracking will occur. Therefore, the drying step is preferably performed at temperatures not exceeding 100° C. If the drying temperature is less than 30° C., the effectiveness of the ammonium ion release compound in modifying the pH of the emulsion surface is decreased and mold generation will occur easily.

The drying means used in the drying step are not critical and any known means such as drying with hot air may be freely used.

The processing method of the present invention comprises a combination of various steps, the embodiments of which are shown below:

(1) Color development–bleach fixing–water washing–stabilizing
(2) Color development–bleach fixing–stabilizing
(3) Color development–fixing–bleach-fixing–water washing–stabilizing
(4) Color development–fixing–bleach-fixing–stabilizing
(5) Color development–bleaching–fixing–water washing–stabilizing
(6) Color development–bleaching–fixing–stabilizing
(7) Black-and-white first development–stopping–water washing–color development–bleachin–fixing–stabilizing
(8) Black-and-white first development–stopping–color development–bleach fixing–stabilizing
(9) Black-and-white first development–stopping–water washing–color development–bleach fixing–water washing–stabilizing
(10) Black-and-white first development–stopping–color development–bleaching–fixing–post-bath–water washing–stabilizing
(11) Special layer-removing bath–color development--bleach fixing–water washing–stabilizing
(12) Black-and-white development–stopping–color development–bleach fixing–water washing–stabilizing A cyan coupler of the following formula (I) or (II) is preferably used in the silver halide color photographic material to be processed by the present invention:

(I)

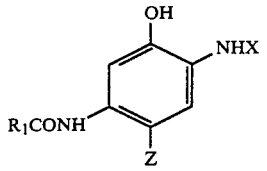

(II)

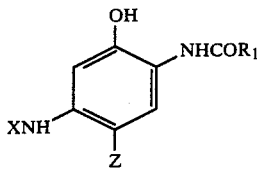

wherein X is

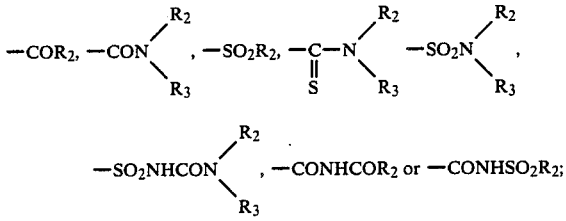

$R_2$ is an alkyl group, preferably an alkyl group of 1 to 20 carbon atoms (e.g. methyl, ethyl, butyl or dodecyl), an alkenyl, preferably an alkenyl group of 2 to 20 carbon atoms (e.g. acyl or oleyl), a cycloalkyl group, preferably a 5- to 7-membered cycloalkyl group (e.g. cyclohexyl), an aryl group (e.g. phenyl, tolyl or naphthyl), a heterocyclic group, preferably a 5- or 6-membered heterocyclic group containing 1 to 4 nitrogen, oxygen or sulfur atoms (e.g. furyl, thienyl or benzothiazolyl); $R_3$ is a hydrogen atom or the same as $R_2$, provided that $R_2$ may combine with $R_3$ to form a 5- or 6-membered hetero ring containing a nitrogen atom. The groups $R_2$ and $R_3$ may have a suitable substituent such as an alkyl group of 1 to 10 carbon atoms (e.g. ethyl, i-propyl, i-butyl, t-butyl or t-octyl), an aryl group (e.g. phenyl of naphthyl), a halogen atom (e.g. fluorine, chlorine or bromine), a cyano group, a nitro group, a sulfonamido group (e.g. methanesulfonamido, butanesulfonamido or p-toluenesulfonamido), a sulfamoyl group (e.g. methylsulfamoyl or phenylsulfamoyl), a sulfonyl group (e.g. methanesulfonyl or p-toluenesulfonyl), a fluorosulfonyl group, a carbamoyl group (e.g. dimethylcarbamoyl or phenylcarbamoyl), an oxycarbonyl group (e.g. ethoxycarbonyl or phenoxycarbonyl), an acyl group (acetyl or benzoyl), a heterocyclic group (pyridyl or pyrazolyl), an alkoxy group, an aryloxy group or an acyloxy group.

In the formulas (I) and (II), $R_1$ represents a ballast group that is necessary to render non-diffusible the cyan coupler of formula (I) or (II) or the cyan dye formed from said cyan coupler. Preferred ballast groups are alkyl groups of 4 to 30 carbon atoms, aryl groups and heterocyclic groups. Also preferred are straight- or branched-chain alkyl groups (e.g. t-butyl, n-octyl, t-octyl and n-dodecyl), alkenyl groups, cycloalkyl groups, and 5- or 6-membered heterocyclic groups.

In the formulas (I) and (II), Z represents a hydrogen atom or a group that can be eliminated when the coupler enters into a coupling reaction with the oxidized form of a color developing agent. Examples of such group include a halogen atom (e.g. fluorine, chlorine or bromine), as well as aryloxy, carbamoyloxy, acyloxy, sulfonamido and succinimido groups having an oxygen atom or nitrogen atom bonded directly to the coupling site. Illustrative examples of Z are shown in U.S. Pat. No. 3,741,563, and Japanese Patent Public Disclosures Nos. 37425/1972, 36894/1973, 10135/1975, 117422/1975, 130441/1975, 108841/1976, 120334/1975, 18315/1977, 105226/1978, 14736/1979, 48237/1979, 32071/1980, 65957/1980, 1938/1981, 12643/1981 and 27147/1981.

For the purpose of the present invention, a cyan coupler of the following formula (III), (IV) or (V) is more preferred:

(III)

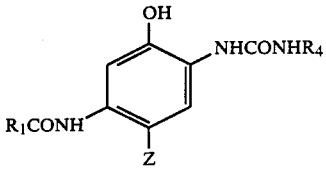

(IV)

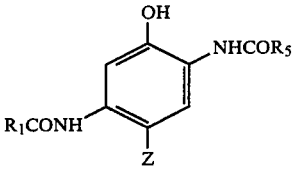

(V)

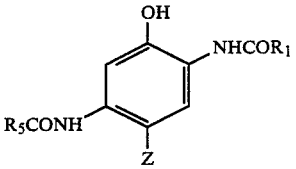

In the formula (III), $R_4$ represents a substituted or unsubstituted aryl group (a phenyl group is particularly preferred). This aryl group may have at least one substituent selected from among $-SO_2R_6$, a halogen atom (e.g. fluorine, bromine or chlorine), $-CF_3$, $-NO_2$, $-CN$, $-COR_6$, $-COOR_6$, $-SO_2OR_6$,

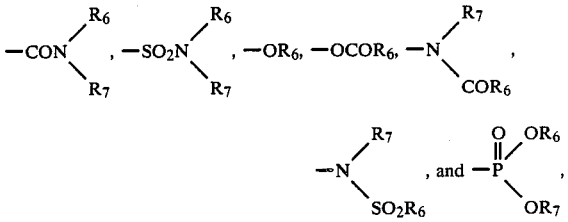

wherein $R_6$ is an alkyl group, preferably an alkyl group of 1 to 20 carbon atoms (e.g. methyl, ethyl, t-butyl or dodecyl), an alkenyl group, preferably an alkenyl group of 2 to 20 carbon atoms (e.g. acyl or olecyl), a cycloalkyl group, preferably a 5- to 7-membered cycloalkyl group (e.g. cyclohexyl), an aryl group (e.g. phenyl, tolyl or naphthyl); and $R_7$ is a hydrogen atom or the same as $R_6$.

A preferred example of the phenolic cyan coupler of formula (III) is such that $R_4$ is a phenyl group optionally substituted by cyano, nitro, $-SO_2R_6$ ($R_6$: alkyl), halogen or trifluoromethyl.

In the formulas (IV) and (V), $R_5$ is an alkyl group, preferably an alkyl group of 1 to 20 carbon atoms (e.g. methyl, ethyl, t-butyl or dodecyl), an alkenyl group, preferably an alkenyl group of 2 to 20 carbon atoms (e.g. acyl or oleyl), a cycloalkyl group, preferably a 5- to 7-membered cycloalkyl group (e.g. cyclohexyl), an aryl group (e.g. phenyl, tolyl or naphthyl), a heterocyclic group, preferably a 5- or 6-membered heterocyclic group containing 1 to 4 nitrogen, oxygen or sulfur atoms (e.g. furyl, thienyl or benzothiazolyl).

The groups $R_6$ and $R_7$ in formula (III), as well as $R_5$ in formula (IV) and (V) may have an optional substituent which is the same as the one that can be introduced into $R_2$ or $R_3$ in formulas (I) and (II). A particularly preferred substituent is a halogen atom (e.g. fluorine or chlorine).

In formulas (III) to (V), Z and $R_1$ each has the same meaning as defined for formulas (I) and (II). A preferred example of the ballast group represented by $R_1$ has the following formula (VI):

(VI)

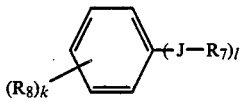

wherein J is an oxygen atom, a sulfur atom or a sulfonyl group; k is an integer of 0 to 4; l is 0 or 1; when k is 2 or more, $R_8$ may be the same or different; $R_7$ is a straight-chain or branched alkylene group of 1 to 20 carbon atoms which may be substituted by an aryl group; $R_8$ represents a monovalent group, such as a hydrogen atom, a halogen atom (preferably chlorine or bromine), an alkyl group, preferably an alkyl group of 1 to 20 carbon atoms (e.g. methyl, t-butyl, t-pentyl, t-octyl, dodecyl, pentadecyl, benzyl or phenetyl), an aryl group (e.g. phenyl), a heterocyclic group (e.g. a nitrogen-containing heterocyclic group), an alkoxy group, preferably a straight-chain or branched alkoxy group of 1 to 20 carbon atoms (e.g. methoxy, ethoxy, t-butyloxy, octyloxy, decyloxy or dodecyloxy), an aryloxy group (e.g. phenoxy), a hydroxy group, an acyloxy group (preferably an alkylcarbonyloxy group), an arylcarbonyloxy group (e.g. acetoxy, benzoyloxy or carboxy), an alkyloxycarbonyl group (preferably a straight-chain or branched alkyloxycarbonyl group of 1 to 20 carbon atoms), an aryloxycarbonyl group (preferably a phenoxycarbonyl group), an alkylthio group (preferably an alkylthio group of 1 to 20 carbon atoms), an acyl group (preferably a straight-chain or branched alkylcarbonyl group of 1 to 20 carbon atoms), an acylamino group (preferably a straight-chain or branched alkylcarboamido or benzenecarboamido group of 1 to 20 carbon atoms), or a sulfonamido group (preferably a straight-chain or branched alkylsulfonamido group of 1 to 20 carbon atoms, or a benzenesulfonamido group), a carbamoyl group (preferably a straight-chain or branched alkylaminocarbonyl or phenylaminocarbonyl group of 1 to 20 carbon atoms), or a sulfamoyl group (preferably a straight-chain or branched alkylaminosulfonyl group of 1 to 20 carbon atoms) or phenylaminosulfonyl group.

Specific examples of the cyan coupler that are used in the present invention are shown in Japanese Patent Application No. 58693/1983, but it should be understood that the scope of the present invention is by no means limited to those compounds.

If a photographic material containing the cyan coupler shown above is stabilized by the method of the present invention, said material can be stored for an extended period without mold production. Even if mold occurs in a small quantity under hostile conditions, the excretion from the mold growth is too small to cause discoloration of the cyan dye.

The silver halide color photographic material that can be processed by the method of the present invention may contain the coupler within itself (as shown in U.S. Pat. Nos. 2,376,679 and 2,801,171) or within a developing solution (as shown in U.S. Pat. Nos. 2,252,718, 2,592,243 and 2,590,970). Any coupler that is commonly known in the art may be used in addition to the cyan coupler.

A suitable magenta coupler has a 5-pyrazolone ring with an active methylene group as the backbone. A suitable yellow coupler has a benzoylacetanilide, pivalylacetanilide or acylacetanilide structure with an active methylene chain; the yellow coupler may or may not have a substituent at the coupling site. Therefore, 2-equivalent and 4-equivalent couplers may be used in the present invention with equally satisfactory results.

The silver halide emulsion used in the photographic material according to the present invention may comprise any silver halide that is selected from among silver chloride, silver bromide, silver iodide, silver chlorobromide, silver chloroiodide, silver iodobromide and silver chloroiodobromide. These silver halides may be protected by various colloidal substances such as natural products (e.g. gelatin) and synthetic products. The silver halide emulsion may contain any conventional photographic additive such as stabilizer, sensitizer, hardener, sensitizing dye or surfactant.

Supports that may be used in the present invention include polyethylene coated paper, triacetate film, poly(ethylene terephthalate) film, and white poly(ethylene terephthalate) film.

The black-and-white developing solution that may be used in the processing according to the present invention may be a first black-and-white developer commonly used in the processing of color photographic materials, or a developer used to process black-and-white photographic materials. The black-and-white developing solution used in the present invention may contain various additives commonly used in black-and-white developers.

Typical additives include a developing agent such as 1-phenylpyrazolidone, Methol or hydroquinone, a preservative such as sulfite, an accelerator made of an alkali such as sodium hydroxide, sodium carbonate or potassium carbonate, an inorganic or organic restrainer such as 2-methylbenzimidazole or methylbenzothiazole, a water softener such as polyphosphoric acid, and an agent to prevent surface overdevelopment which is made of a trace amount of iodide or mercapto compound.

A wide variety of known aromatic primary amine color developing agents commonly used in various color photographic processes may be incorporated in the color developer for use in the processing according to the present invention. Such developing agents include aminophenolic and p-phenylenediamine derivatives. These compounds are not usually employed in their free form; rather, they are used in stabler salt forms such as hydrochlorides or sulfates. These compounds are typically used in concentrations ranging from ca. 0.1 g to ca. 30 g, preferably from ca. 1 g to ca. 15 g, per liter of the color developer.

Illustrative aminophenolic developing agents include o-aminophenol, p-aminophenol, 5-amino-2-oxy-toluene, 2-amino-3-oxy-toluene, and 2-oxy-3-amino-1,4-dimethyl-benzene.

Useful primary aromatic amino color developing agents are N,N-dialkyl-p-phenylenediamine compounds, wherein the alkyl and phenyl groups may or may not be substituted. Particularly useful compounds include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-β-methanesulfonamidoethyl-3-methyl-4-aminoaniline sulfate, N-ethyl-N-β-hydroxyethylaminoaniline, 4-amino-3-methyl-N,N-diethylaniline and 4-amino-N-(2-methoxyethyl)-N-ethyl-3-methylaniline-p-toluenesulfonate.

The alkaline color developing solution used in the processing according to the present invention may further contain various additives commonly incorporated in color developers; such additives include alkali agents such as sodium hydroxide, sodium carbonate and potassium carbonate; alkali metal sulfites, alkali metal bisulfites, alkali metal thiocyanates, alkali metal halides and benzyl alcohol; water softeners; and thickeners. The color developer used in the present invention generally has a pH of 7 or higher, and most commonly at between about 10 and about 13.

A bleaching solution or bleach-fix solution is used in the bleaching step. Metal complex salts of organic acids may be used as the bleaching agent; their function is to oxidize metallic silver (as produced by development) into silver halide and at the same time to develop color in the uncolored portion of the coupler. The structure of these complex salts is such that a metal ion such as iron, cobalt or copper is coordinated with an organic acid such as aminopolycarboxylic acid, oxalic acid or citric acid. Most preferred organic acids for use in the formation of such complex salts include polycarboxylic acids and aminopolycarboxylic acids. These organic acids may be in the form of alkali metal salts, ammonium salts or water-soluble amine salts.

Typical examples of these organic acids are listed below:

(1) ethylenediaminetetraacetic acid
(2) diethylenetriaminepentaacetic acid
(3) ethylenediamine-N-(β-oxyethyl)-N,N',N,-triacetic acid
(4) propylenediaminetetraacetic acid
(5) nitrilotriacetic acid
(6) cyclohexanediaminetetraacetic acid
(7) iminodiacetic acid
(8) dihydroxyethylglycinecitric acid (or tartaric acid)
(9) ethyl etherdiaminetetraacetic acid
(10) glycol ether diaminetetraacetic acid
(11) ethylenediaminetetrapropionic acid
(12) phenylenediaminetetraacetic acid
(13) ethylenediaminetetraacetic acid disodium salt
(14) ethylenediaminetetraacetic acid (trimethylammonium) salt
(15) ethylenediaminetetraacetic acid tetrasodium salt
(16) diethylenetriaminepentaacetic acid pentasodium salt
(17) ethylenediamine-N-(β-oxyethyl)-N,N',N'-triacetic acid sodium salt
(18) propylenediaminetetraacetic acid sodium salt
(19) nitrilotriacetic acid sodium salt
(20) cyclohexanediaminetetraacetic acid sodium salt The bleaching solution may contain various additives in addition to the metal complex salt of organic acid used as the bleaching agent. Any additives that are conventionally incorporated in bleaching solutions may be used, and they include re-halogenating agents such as alkali halides and ammonium halides (e.g. potassium bromide, sodium bromide, sodium chloride and ammonium bromide), pH buffers such as borates, oxalates, acetates, carbonates or phosphates; alkylamines and polyethyleneoxides.

If a bleach-fix solution is used in the bleaching step, it should have both bleaching and fixing functions. Therefore, the blix solution must contain not only the bleaching agent but also a fixing agent of the same type as is incorporated in fixing solutions.

Examples of the fixing agent used in the fixing solution or bleach-fix solution are those compounds which react with silver halide to form water-soluble complex salts, such as thiosulfates (e.g. potassium thiosulfate, sodium thiosulfate and ammonium thiosulfate), thiocyanates (e.g. potassium thiocyanate, sodium thiocyanate and ammonium thiocyanate); thiourea and thioether.

The fixing solution and bleach-fix solution may further contain one or more pH buffers selected from among sulfites (e.g. ammonium sulfite, potassium sulfite, ammonium bisulfite, potassium bisulfite, sodium bisulfite, ammonium metabisulfite, potassium metabisulfite and sodium metabisulfite) and salts (e.g. borax, sodium hydroxide, potassium hydroxide, sodium carbonate, potassium carbonate, sodium bicarbonate, potassium bicarbonate, sodium acetate and ammonium hydroxide).

If the bleach-fix solution (bath) is selectively replenished with a particular component, the thiosulfate, thiocyanate or sulfite may be incorporated in the stabilizing solution according to the present invention, but then such a stabilizing solution is preferably replenished in a selective manner.

In order to increase the activity of the bleach-fix solution, air or oxygen may be blown into the bleach-fix bath or the tank containing the bleach-fix replenisher. Alternatively, a suitable oxidizing agent such as hydrogen peroxide, bromate or persulfate may be added.

In the processing according to the present invention, silver may be recovered not only from the stabilizing solution but also from a processing solution containing a soluble silver complex salt such as fixing solution or bleach-fix solution by any known method. Techniques that can be used effectively for this purpose include electrolysis (French Patent No. 2,299,667), precipitation (Japanese Patent Public Disclosure No. 73037/1977 and German Patent No. 2,331,220), ion exchange (Japanese Patent Public Disclosure No. 17114/1976 and German Patent No. 2,548,237) and metal displacement (British Patent No. 1,353,805).

The present invention is hereunder shown in greater detail by reference to working examples, to which the scope of the invention is by no means limited.

EXAMPLE 1

A paper support coated with a polyethylene layer containing anatase titanium oxide as a white pigment was surface-treated by corona discharge. After this pre-treatment, the following layers were successively formed on the support to provide samples of color print paper.

First layer: Silver chlorobromide emulsion containing 5 mol % of silver chloride was spectrally sensitized by anhydro-5-methyl-5'-methoxy-3,3'-di(3-sulfopropyl)selenacyaninhydroxide, mixed with 2,5-di-t-butyl hydroquinone and a protect dispersion of α-[4-(1-benzyl-2-phenyl-3,5-dioxo-1,2,4-triazolidyl)]-α-pivalyl-2-chloro-5-[γ-(2,4-di-t-amylphenoxy)-butylamido)acetanilide (i.e., yellow coupler), and applied to give a silver deposit of 0.35 g/m².

Second layer: Gelatin solution containing di-t-octyl hydroquinone and a protect dispersion of a UV absorbent, i.e., a mixture of 2-(2'-hydroxy-3',5'-di-t-butylphenyl)benzotriazole, 2-(2'-hydroxy-5'-t-butylphenyl)-benzotriazole, 2-(2'-hydroxy-3'-t-butyl-5'-methylphenyl)-5-chlorobenzotriazole and 2-(2-hydroxy-3',5'-di-t-butylphenyl)-5-chlorobenzotriazole was applied as an intermediate layer.

Third layer: Silver chlorobromide emulsion containing 15 mol % of silver chloride was spectrally sensitized by anhydro-9-ethyl-5,5'-diphenyl-3,3'-di-(3-sulfopropyl-)oxacarbocyaninhydroxide, mixed with 2,5-di-t-butyl hydroquinone and 2,2,4-trimethyl-6-lauryloxy-7-t-octylchroman, and a protect dispersion of 1-(2,4,6-trichlorophenyl)-3-(2-chloro-5-octadecenylsuccinimidoanilino)-5-pyrazolone (i.e., magenta coupler), and applied to give a silver deposit of 0.4 g/m².

Fourth layer: A solution having the same composition as that used in preparing the second layer was applied as an intermediate layer.

Fifth layer: Silver chlorobromide emulsion containing 15 mol % of silver chloride was spectrally sensitized with anhydro-2-[3-ethyl-5-(1-ethyl-4(1H)-quinolylidene)ethylidene-4-oxo-thiazolydine-2-ylidene]methyl-3-(3-sulfopropyl)benzoxazolium hydroxide, mixed with 2,5-di-t-butyl hydroquinone and a protect dispersion in a high-boiling solvent of 4-chloro-2-(pentafluorobenzamido-5-[α-(2,4-di-t-pentylphenoxy)-iso-valeroamido]phenol, and applied to give a silver deposit of 0.27 g/m².

Sixth layer: Gelatin solution was applied to form a protective layer.

Each of the silver halide photographic emulsions used in the three sensitive layers was prepared by the method shown in Japanese Patent Publication No. 7772/1971, and thereafter sensitized chemically with sodium thiosulfate and added with 4-hydroxy-6-methyl-1,3,3a,7-tetrazaindene (stabilizer). The coating solutions for all photographic layers contained saponin (coating aid) and bis(vinylsulfonylmethyl)ether (hardener). The samples of color print paper thus prepared were subjected to stepwise exposure with a sensitometer (Model KS-7 of Konishiroku Photo Industry Co., Ltd.), color-developed, bleach-fixed and washed. These photographic steps were conducted by a Sakura color paper processor (Model CPK-18P of Konishiroku Photo Industry Co., Ltd.). The processed samples were immersed in stabilizing solutions Nos. (1) to (13) for 3 minutes at 30° C. The formulation of the stabilizing solutions is shown below. The treated samples were dried at 60° C. and subjected to an incubation test.

Formulation of the stabilizing solutions

| | |
|---|---|
| 1-Hydroxy-ethylidene-1,1-diphosphonic acid (60%) | 2 g |
| Bismuth chloride | 1.0 g |
| Magnesium chloride | 0.5 g |
| Sulfuric acid | 0.5 g |
| Ammonium ion releasing compound (see Table 1) | |
| Water to make | 1,000 ml |

The pH values of the respective solutions were adjusted to the values shown in Table 1.

Incubation test

The pH of the surface of the emulsion layer on each color paper sample was measured with a composite electrode. The pH meter was an Orion Ion Analyzer. Each of the samples was cut to a square shape (2.5 cm×2.5 cm) and placed in a Petri dish containing agar as a water source. Three fungal species, i.e., Aspergillus niger, Penicillium citrinum and Ketronium A glucus, were suspended in a solution of Tween-80 (surfactant), diluted with 0.8% of potato dextrose-agar, inoculated on the center of each print in an amount of 0.05 ml, and covered with a slide glass.

Fungal growth was observed on the 10th, 20th and 30th days. The results are shown in Table 1 according to the following rating indexes: O, no growth; Δ, mold covered less than a third of the paper; X, mold covered more than a third of the paper. The growth of hyphae was evaluated by the length in cm from the edge of the slide glass.

In a separate test, the samples developed after wedge exposure were treated with stabilizers Nos. (1) to (13) and stored for 2 weeks at 80° C. and 80% r.h. The maximum red density was compared with the corresponding density for the freshly treated samples to determine the percent discoloration of cyan dye. The density of yellow stain in the unexposed area was also measured. The results of cyan dye discoloration are shown in Table 1, wherein XX indicates 20% or more discoloration, X refers to 10–20% discoloration, and o less than 10% discoloration. The results of yellow stain measurement are also shown in Table 1, in which XX indicates more than 0.30, X refers to 0.2–0.3, and o less than 0.2.

Samples Nos. 7 to 13 which were treated according to the present invention had pH values on the surface of the emulsion layer which were within the range specified by the invention, and these desired values were obtained irrespective of the pH levels of the stabilizing solutions used. As a result, the samples exhibited improved image stability (i.e., minimum yellow staining and cyan dye discoloration, and the entire absence of mold growth).

TABLE 1

| Sample No. | | (1) | (2) | (3) | (4) | (5) | (6) | (7) |
|---|---|---|---|---|---|---|---|---|
| Ammonium ion releasing compound | | Non-washing | Sodium citrate 10 g | Sodium acetate 10 g Acetic acid 3 g | Sodium sulfate 10 g | Sodium sulfite 10 g | Potassium sulfate 10 g | 25% Ammonia water 2.0 ml |
| pH of stabilizing solution | | 7.01 | 4.5 | 4.5 | 6.8 | 6.8 | 6.8 | 3.0 |
| pH of the surface of dried emulsion film | | 7.22 | 5.4 | 5.8 | 7.86 | 7.46 | 7.96 | 4.6 |
| Image quality upon | Yellow stain | X | Δ | Δ | X | X | X | |
| | Cyan dye | X | | | X | X | X | |

TABLE 1-continued

| | | | | | | | | |
|---|---|---|---|---|---|---|---|---|
| storage | discoloration | | | | | | | |
| Mold inhibition | | | | | | | | |
| 10d. | Mold grows | | X | X | | | | |
| | Length of hyphae (cm) | 0 | 0.4 | 1.2 | 0 | 0 | 0 | 0 |
| 20d. | Mold growth | Δ | X | X | | Δ | | |
| | Length of hyphae (cm) | 0.3 | 2 | 4 | 0 | 0.3 | 0 | 0 |
| 30d. | Mold growth | X | X | X | X | X | X | |
| | Length of hyphae (cm) | 3.0 | 5 | 5 | 2.0 | 3.6 | 2.0 | 0 |

| Sample No. | | (8) | (9) | (10) | (11) | (12) | (13) |
|---|---|---|---|---|---|---|---|
| Ammonium ion releasing compound | | 25% ammonia water 2.0 ml | 25% ammonia water 4.0 ml | 25% ammonia water 10 ml | Ammonium 1-hydroxy ethylidene-1,1-diphosphonate 2.0 g | Ammonium sulfate 2.5 g | Ammonium carbonate 2.3 g |
| pH of stabilizing solution | | 7.1 | 7.8 | 8.5 | 7.0 | 7.0 | 7.0 |
| pH of the surface of dried emulsion film | | 5.2 | 4.8 | 4.3 | 5.9 | 5.5 | 5.6 |
| Image quality upon storage | Yellow stain | | | | | | |
| | Cyan dye discoloration | | | | | | |
| Mold inhibition | | | | | | | |
| 10d. | Mold grows | | | | | | |
| | Length of hyphae (cm) | 0 | 0 | 0 | 0 | 0 | 0 |
| 20d. | Mold growth | | | | | | |
| | Length of hyphae (cm) | 0 | 0 | 0 | 0 | 0 | 0 |
| 30d. | Mold growth | | | | | | |
| | Length of hyphae (cm) | 0 | 0 | 0 | 0 | 0 | 0 |

Pictures were taken with color negative film rolls (size: 135, 24 frames) (product of Konishiroku Photo Industry Co., Ltd.) in a camera (Konica ACOM-1, product of Konishiroku Photo Industry Co., Ltd.). The films were processed by an automatic processor for 14 consecutive days at a rate of 20 rolls/day. The scheme of the processing was as follows:

| | Temperature | Time |
|---|---|---|
| Color development | 38° C. | 3 min 15 sec |
| Bleaching | 38° C. | 6 min |
| Fixing | 38° C. | 4 min |
| Washing | 30° C. | 1 min |
| Stabilization | 33° C. | 1 min |
| Drying | — | — |

The color development, bleaching and fixing were performed by using a color negative processing agent (Sakura CNK-4, product of Konishiroku Photo Industry Co., Ltd.). The formulation of the stabilizing solution is shown below.

| | |
|---|---|
| Polyoxyethylene (n = 10) | 0.5 g |
| Octylphenol ether | 0.1 g |
| Formalin (37%) | 4.0 g |
| L-77 (activator of Union Carbide Corporation) | 0.3 g |
| Ammonium ion releasing compound (see Table 2) | |
| Water to make | 1,000 ml |

The processed samples were subjected to an incubation test and a cyan dye discoloration test as in Example 1. The results are shown in Table 2.

TABLE 2

| Sample No. | (14) | (15) | (16) | (17) | (18) |
|---|---|---|---|---|---|
| Ammonium ion releasing compound | None | 25% Ammonia water 100 g | 25% Ammonia water 0.5 g | 25% Ammonia water 4.0 g | Ammonium 1-hydroxy-ethylidene-1,1-diphosphonate 2.0 g |

TABLE 2-continued

| Sample No. | | (14) | (15) | (16) | (17) | (18) |
|---|---|---|---|---|---|---|
| pH of stabilizing solution | | 6.96 | 7.0 | 7.0 | 7.0 | 7.0 |
| pH of the surface of dried emulsion film | | 7.51 | 2.7 | 5.7 | 4.86 | 5.20 |
| Cyan dye discoloration | | X | XX | | | |
| Mold inhibition | | | | | | |
| 10d. | mold growth length of hyphae (cm) | 0 | 0 | 0 | 0 | 0 |
| 20d. | mold growth length of hyphae (cm) | X<br>1.2 | X<br>1.4 | 0 | 0 | 0 |
| 30d. | mold growth length of hyphae (cm) | X<br>4 | X<br>4 | 0 | 0 | 0 |

As Table 2 shows, the method of the present invention also proves effective in stabilizing a silver halide color photographic material even when an activator or formalin is contained in the stabilizer. Sample No. (14) was treated with a stabilizing solution containing no ammonia; Sample No. (15) was treated with a stabilizing solution containing an ammonium ion releasing compound which was within the scope of the invention but after drying, the pH of the surface of the emulsion layer on the sample was outside the range specified by the invention. These two comparative samples were defective in that they were highly sensitive to mold growth or experienced a high degree of discoloration of the cyan dye.

Samples Nos. (16) to (18) treated according to the present invention remained much more stable than the comparative samples; they experienced minimum discoloration of cyan dye and were entirely free from mold growth.

What is claimed is:

1. A method of processing a silver halide color photographic material which comprises imagewise exposing said photographic material to light, developing said photographic material, removing the residual image-forming silver, treating the material in substantially the final stage of color processing with an aqueous solution containing a compound which releases ammonium ions in the solution, said compound being selected from the group consisting of an aqueous solution of ammonia, ammonium hydroxide, ammonium carbonate, ammonium hydrogencarbonate, ammonium sulfate, ammonium hydrogensulfate, ammonium nitrate, ammonium sulfate, ammonium benzoate, ammonium hydroxyethyliminodiacetate, ammonium trans-cyclohexanediamintetraacetate, ammonium nitrilotrimethylenephosphonate, ammonium ethylenediamine-tetramethylenephosphonate, ammonium 1-hydroxyethylidene-1,1 -diphosphonate, ammonium 2-phosphonbutane-1,2,4-tricarbonxylate and ammonium cerium (IV) sulfate, thereafter drying the material at a temperature not lower than 30° C., wherein said treatment with said aqueous solution and said drying adjusts the pH of the surface of the dried emulsion layer to between 3.0 and 6.8.

2. A method according to claim 1 wherein said color processing comprises development, bleaching and/or fixing and stabilization.

3. A method according to claim 1 wherein said compound which releases ammonium ions is at least one selected from the group consisting of aqueous solution of ammonia, ammonium hydroxide, ammonium sulfate, ammonium hydrogen-sulfate, ammonium carbonate, ammonium, hydrogencarbonate, and ammonium 1-hydroxyethylidene-1,1 -diphosphonate.

4. A method according to claim 1 wherein said silver halide color photographic material has incorporated therein a cyan coupler represented by the following formula (I) or (II):

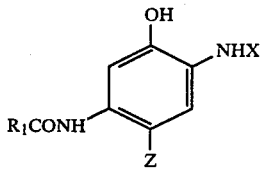

(I)

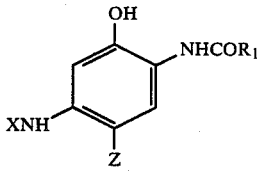

(II)

wherein $R_1$ is a ballast group; X is

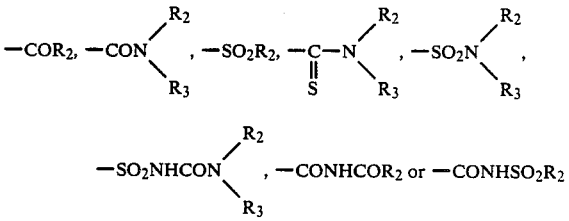

(wherein $R_2$ is an alkyl group, an alkenyl group, a cycloalkyl group, an aryl group, or a heterocyclic group; and $R_3$ is a hydrogen atom or the same as $R_2$; provided that $R_2$ may combine with $R_3$ to form a 5- or 6-membered hetero ring containing a nitrogen atom); and Z represents a hydrogen atom or a group that can be eliminated when the coupler enters into a coupling reaction with the oxidized form of a color developing agent.

5. A method according to claim 4 wherein said coupler is a cyan coupler represented by the following formula (III), (IV) or (V):

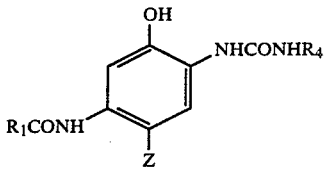

(III)

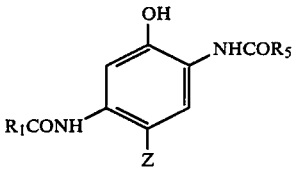

(IV)

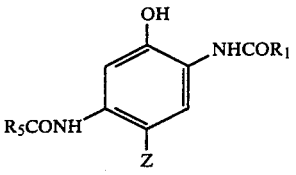

(V)

wherein $R_1$ and Z are as defined in formulas (I) and (II) above; $R_4$ represents an aryl group; and $R_5$ represents an alkyl group, an alkenyl group, a cycloalkyl group, an aryl group, or a heterocyclic group.

6. A method according to claim 1 wherein said aqueous solution has a pH in the range of 1 to 9.5.

7. A method according to claim 19 wherein said aqueous solution has a pH in the range of 3 to 8.5.

8. A method according to claim 1 wherein said compound which releases ammonium ions is used in an amount ranging from 0.01 to 30 g per liter of said aqueous solution.

9. A method according to claim 8 wherein said compound which releases ammonium ions is used in an amount ranging from 0.1 to 5 g per liter of said aqueous solution.

10. A method of processing a silver halide color photographic material which comprises imagewise exposing said photographic material to light developing said photographic material, removing the residual image-forming silver, treating the material, in substantially the final stage of color processing, with an aqueous solution containing a compound which releases ammonium ions in the solution, said compound being selected from the group consisting of an aqueous solution of ammonia, ammonium hydroxide, ammonium carbonate, ammonium hydrogencarbonate, ammonium sulfate, ammonium hydrogensulfate, ammonium nitrate, ammonium sulfamate, ammonium benzoate, ammonium hydroxyethyliminodiacetate, ammonium tran-cyclohexanediameintetraacetate, ammonium nitrilotrimethylenephosphonate, ammonium ethylenediamintetramethylenephosphonate, ammonium 1-hydroxyethylidene-1,1'-diphosphonate, ammonium 2-phosphonbutane-1,2,4-tricarboxylate and ammonium carium (IV) sulfate, and the step of water-washing prior to said treatment in the final stage of color processing being excluded, thereafter drying the material at a temperature not lower than 30° C., wherein said treatment with said aqueous solution and said drying adjusts the pH of the surface of the dried emulsion layer to between 3.0 and 6.8.

11. A method according to claim 6, wherein said color processing comprises development, bleaching and/or fixing and stabilization.

12. A method according to claim 6, wherein said compound which releases ammonium ions is at least one selected from the group consisting of aqueous solution of ammonia, ammonium hydroxide, ammonium sulfate, ammonium hydrogensulfate, ammonium carbonate, ammonium hydrogencarbonate, and ammonium 1-hydroxyethylidene-1,1'-diphosphonate.

13. A mehtod according to claim 6, wherein said silver halide color photographic material has incorporated therein a cyan coupler represented by the following formula (I) or (II):

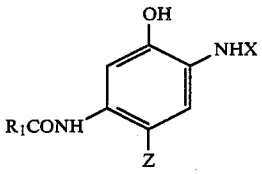

(I)

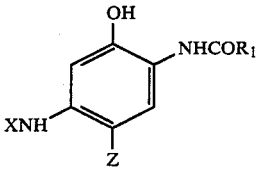

(II)

wherein $R_1$ is a ballast group; X is

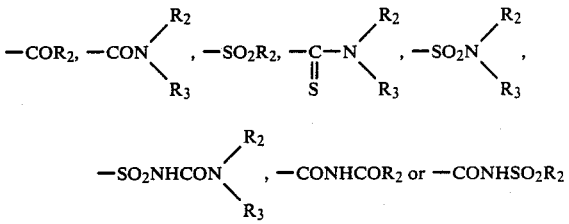

(wherein $R_2$ is an alkyl group, an alkenyl group, a cycloalkyl group, and aryl group, or a heterocyclic group; and $R_3$ is a hydrogen atom or the same as $R_2$; provided that $R_2$ may combine with $R_3$ to form a 5- or 6-membered hetero ring containing a nitrogen atom); and Z represents a hydrogen atom or a group that can be eliminated when the coupler enters into a coupling reaction with the oxidized form of a color developing agent.

14. A method according to claim 13 wherein said coupler is a cyan coupler represented by the following formula (III), (IV) or (V):

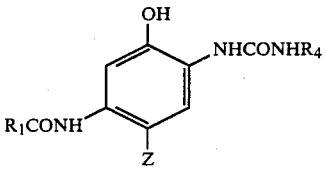

(III)

-continued (IV)

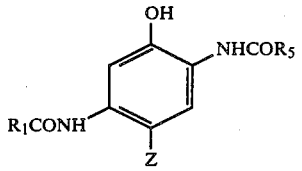

(V)

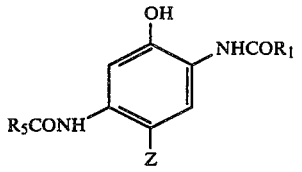

wherein $R_1$ and Z are as defined in formulas (I) and (II) above; $R_4$ represents an aryl group; and $R_5$ represents an alkyl group, alkenyl group, a cycloalkyl group, an aryl group, or a heterocyclic group.

15. A method according to claim 10 wherein said aqueous solution has a pH in the range of 1 to 9.5.

16. A method according to claim 15 wherein said aqueous solution has a pH in the range of 3 to 8.5.

17. A method according to claim 10 wherein said compound which releases ammonium ions is used in an amount ranging from 0.01 to 30 g per liter of said aqueous solution.

18. A method according to claim 17 wherein said compound which releases ammonium ions is used in an amount ranging from 0.1 to 5 g per liter of said aqueous solution.

* * * * *